US005902944A

United States Patent [19]

Grossman

[11] Patent Number: 5,902,944

[45] Date of Patent: May 11, 1999

[54] FINGER-CONTROLLED MEANS FOR CONTACTING STRINGS ON A GUITAR

[76] Inventor: Leland Grossman, P.O. Box 176, R.R. 1, Anamoose, N. Dak. 58710

[21] Appl. No.: 08/779,386

[22] Filed: Jan. 7, 1997

[51] Int. Cl.[6] ..... G10D 3/00

[52] U.S. Cl. ..... 84/315; 84/316; 84/317; 84/318; 84/319

[58] Field of Search ..... 84/315–319

[56] References Cited

U.S. PATENT DOCUMENTS

| | | | |
|---|---|---|---|
| 1,748,053 | 5/1930 | Blair | 84/315 |
| 2,025,788 | 12/1935 | Spina | 84/315 |
| 3,922,945 | 12/1975 | Pettijohn | 84/319 |
| 4,331,059 | 5/1982 | Marabotto | 84/317 |
| 4,471,682 | 9/1984 | Bozung | 84/319 |
| 4,796,506 | 1/1989 | Gray | 84/317 |
| 5,515,762 | 5/1996 | Perkins et al. | 84/315 |
| 5,593,595 | 1/1997 | Rand, Jr. | 84/317 |
| 5,623,110 | 4/1997 | Hoglund et al. | 84/318 |

*Primary Examiner*—William M. Shoop, Jr.

*Assistant Examiner*—Kim Lockett

*Attorney, Agent, or Firm*—David A. Lingbeck

[57] ABSTRACT

Finger-controlled members for contacting the strings on a guitar includes three string-contacting finger members, one for the index finger, one for the middle or second finger, and one for the third or ring finger. Each of the string-contacting finger members is securely fastenable upon the respective finger such that it is on the palm-side of the finger and on the second segment of the finger so that the user can manipulate the string-contacting finger members with one's finger tips. Each string-contacting finger member has a body with a single string contact stem extending from the bottom thereof and being capable of holding only one string against the fingerboard of the guitar. In addition, there are four multiple string contact attachments which can be detachably attached to the string-contacting finger members and which have bottoms that are capable of holding two or three consecutive strings or two nonconsecutive strings against the fingerboard of the guitar to achieve selected musical chords. These finger-controlled members saves the user's fingers and also allows certain users having large fingers to more accurately play the guitar.

19 Claims, 4 Drawing Sheets

FINGER-CONTROLLED MEANS FOR CONTACTING STRINGS ON A GUITAR

BACKGROUND OF THE INVENTION

This invention relates to finger-controlled means for contacting strings on a guitar instead of the user using one's own fingers to do so. These finger-controlled mechanism simply slip on the index finger, the second or middle finger, and the third or ring finger of the hand for playing the various chords on the fingerboard of the guitar which may be an acoustic or electric guitar.

The prior art discloses that plectrums are commonly used by users to pluck the strings on a guitar and that the users use their fingers on the hand which is on the stock of the guitar to press down the strings to receive the chords they want. However, because some of the users have developed blisters on their fingers and some have problems pressing down the correct selected strings because their fingers are too large, there has been a need to develop devices which will fit upon the fingers of the users and which will be used to press down the selected strings on the guitar.

One known prior art is a HAND HELD CHORD FINGERING DEVICE FOR GUITAR, U.S. Pat. No. 3,922,945, issued on Dec. 2, 1975 and invented by Robert Pettijohn, comprising a unitary hand held, chord fingering device having a generally palm sized body, a plurality of fingering pads placed on the operative side of the body, and a finger strap to mount about the index finger of the user.

Another known prior art is a FINGER MOUNTABLE GUITAR STRING CONTACT DEVICE, U.S. Pat. No. 3,854,368, issued on Dec. 17, 1974 and invented by Leonard Pogan, comprising a generally cylindrical string contact member having a longitudinal axis and being mountable upon the middle segment of the fourth finger of the user.

None of the prior art discloses a finger controlled means which are secured to more than one finger for contacting the strings on a guitar.

SUMMARY OF THE INVENTION

The present invention relates to finger-controlled mechanism for contacting the strings on the fingerboard of a guitar comprising a string-contacting index finger member, a string-contacting second finger member, and a string-contacting third finger member. Each of the finger members have a body, a single string contact stem extending downward from a bottom of the body, and at least one removable multiple string contact attachment also extending downward from the body and being forward of the single string contact stem. In addition, each of the finger members have a finger mounting means such as a band into which the respective finger extends and supports the particular finger member. Each finger essentially rests on top of the respective finger member which is suspended from the finger such that the user can control the strings on the fingerboard of the guitar. Instead of using the tips of the fingers directly, the user uses the finger members to press certain selected strings against the fingerboard of the guitar to receive certain chords.

One objective of the present invention is to provide a finger-controlled mechanism for contacting the strings on a guitar which allows the users to play the guitar better than if they were using their fingers.

Another objective of the present invention is to provide a finger-controlled mechanism for contacting the strings on a guitar which allows users whose fingers are too large to effectively play the guitar.

Further, another objective of the present invention is to provide a finger-controlled mechanism for contacting the strings on a guitar which substantially protects the fingers of the users.

Yet, another objective of the present invention is to provide a finger-controlled mechanism for contacting the strings on a guitar which substantially prevents users from getting blisters on their fingers while playing the guitar.

Further objectives and advantages of the present invention will become apparent as the description proceeds and when taken in conjunction with the accompanying drawings wherein:

DETAILED DESCRIPTION OF THE INVENTION

Figures 1, 2:
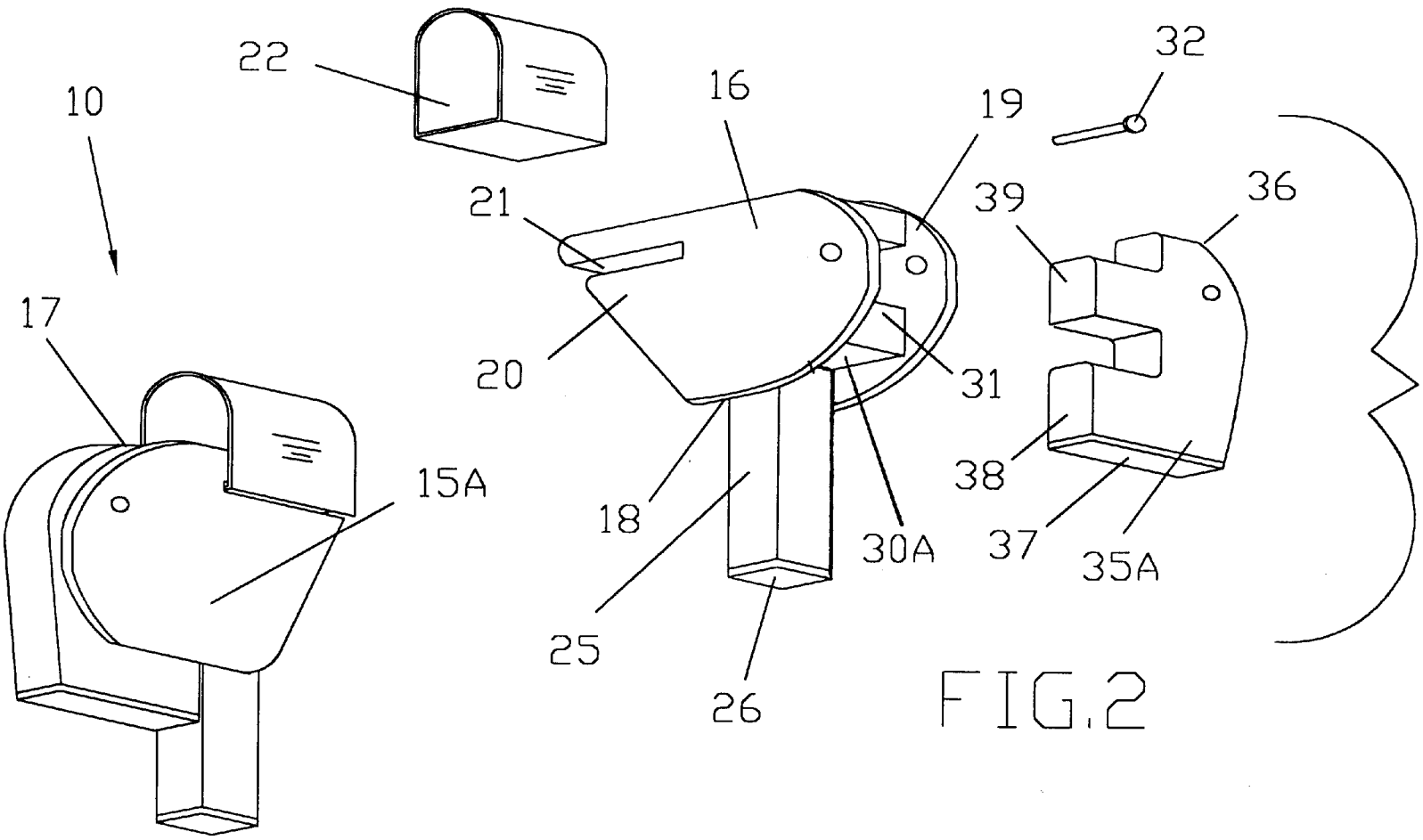
FIG. 1 is a front perspective view of the string contacting index finger member of the finger-controlled mechanism for contacting the strings on a guitar with a multiple string contact attachment attached to the body of the finger member.
FIG. 2 is a rear exploded perspective view of the string contacting index finger member of the finger-controlled mechanism for contacting the strings on a guitar with a multiple string contact attachment removed from the body of the finger member.
Figure 4:
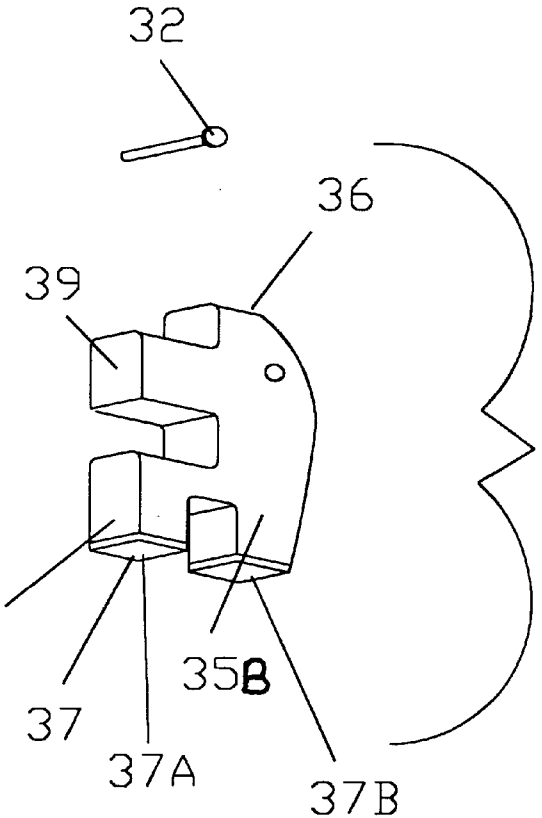
FIG. 4 is a rear perspective view of the string contacting second finger member of the finger-controlled mechanism for contacting the strings on a guitar with the multiple string contact attachment removed from the body of the finger member.
Figure 3:
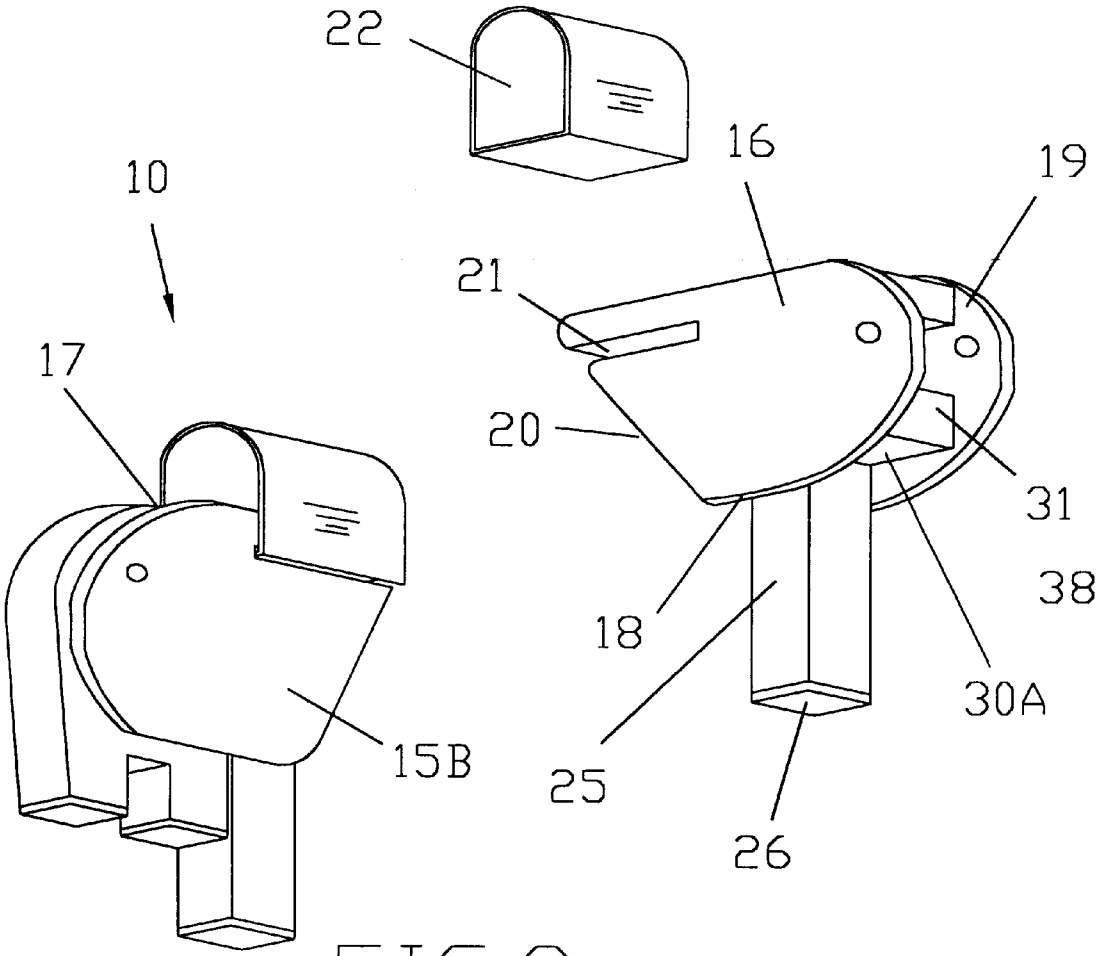
FIG. 3 is a front perspective view of the string contacting second finger member of the finger-controlled mechanism for contacting the strings on a guitar with the multiple string contact attachment attached to the body of the finger member.

Referring to the drawings in FIGS. 1 through 7, in particular, the finger-controlled mechanism 10 for contacting the strings 51 on a guitar comprises three string-contacting finger members 15A–C each of which fits upon a respective finger on the hand which is used to manipulate the strings 51 on the fingerboard 50 of a guitar, one of which is a string-contacting index finger member 15A, another of which is a string-contacting second finger member 15B, and the remaining one of which is a string-contacting third finger member 15C. Each of the string-contacting finger members 15A–C has a body 16 which has an essentially planar top 17 upon which the respective finger rests, a bottom 18, a front end 19, and a back end 20, and at least one slot 30A–B disposed in the front end 19 of the body 16 and of which is defined by opposed side walls forming a portion of the body 16 with each slot 30A–B having a recessed portion 31 therein directed toward the back end 20 of the body 16. The string-contacting third finger member 15C has two side-by-side, horizontally-disposed slots separated by a common partition in the front end 19 of the body 16. Each of the string-contacting finger members 15A–C further has a single string contact stem 25 which is integrally attached to and extends downward from the bottom 18 and near the back end 20 of the body 16 and which is generally perpendicular to the planar top 17 of the body 16. Each of the single string contact stems 25 has a distal end 26 which is slightly angled relative to the longitudinal axis of the respective single string contact stem 25 and which has a nonslip surface such that when placed upon a string on the fingerboard 50 of the guitar, it won't slip off. The distal end 26 of each single string contact stem 25 is slightly angled rearwardly upward to facilitate the holding of a string of the guitar against the fingerboard 50 when the respective string-contacting finger member is being used.

As shown in FIGS. 1–7, each of the string-contacting finger members 15A–C has a finger mounting means 22 such as a semi-rigid band adapted for fitting on the finger and for supporting the respective string-contacting finger member such that the user can conveniently manipulate the string-contacting finger member to hold selected strings 51 against the fingerboard 50 of the guitar to achieve certain chords. The finger mounting means 22 essentially is capable of fitting upon all sizes of fingers and generally upon the second segment of the particular finger. Each of the string-contacting finger members 15A–C has a slit 21 through the back end 20 and near the top 17 of the respective body 16, the slit 21 being adapted to engageably receive a portion of the finger mounting means 22 with most of the finger mounting means 22 being disposed above the planar top 17 of the body 16, except the finger mounting means 22 for the string-contacting first finger member 15A is somewhat offset to the left on top of the string-contacting first finger member 15A. The string-contacting third finger member 15C has a groove centrally extending from the back end 20 of the body 16 and through the planar top 17 with the slit 21 being disposed generally parallel to the planar top 17 and through the upper right half portion of the back end 20 of the body 16 with the finger mounting means 22 being offset to the right half portion of the body 16 directly above the single string contact stem 25 which is also offset on the right half portion of the body 16. Each of the finger mounting means 22 of the string-contacting finger members 15A–C easily slide on the respective fingers of the user with the string-contacting finger members 15A–C being suspended on the palm-side of the fingers since the tips of the fingers on the palm-side are what hold the strings 51 against the fingerboard 50 of the guitar.

In addition to the single string contact stems, there are four multiple string contact attachments 35A–D which can be removeably attached with fastening members 32 such as pins, one in each of the slots of the bodies of the string-contacting finger members 15A–C and which are adapted to press two or more strings 51 against the fingerboard 50 of the guitar to achieve a particular musical chord that the user wants to play. Each of the multiple string contact attachments 35A–D is generally a narrow, elongate member having two sides, a top portion 36, a bottom end 37 adapted to hold the strings 51 against the fingerboard 50 to achieve a particular musical chord, and a back portion 38 which has a lug 39 protruding therefrom near the top portion 36 and which is engageable in the recessed portion 31 of a respective one of the slots 30A–B such that the multiple string contact attachment 35A–D is secured in a stationary position with the narrow, elongate member extending downward below the body 16 and forward of the single string contact stem 25 which is relatively longer than the any of the multiple string contact attachments 35A–D and with the bottom end 37 facing generally away from the body 16.

Figures 5, 6:
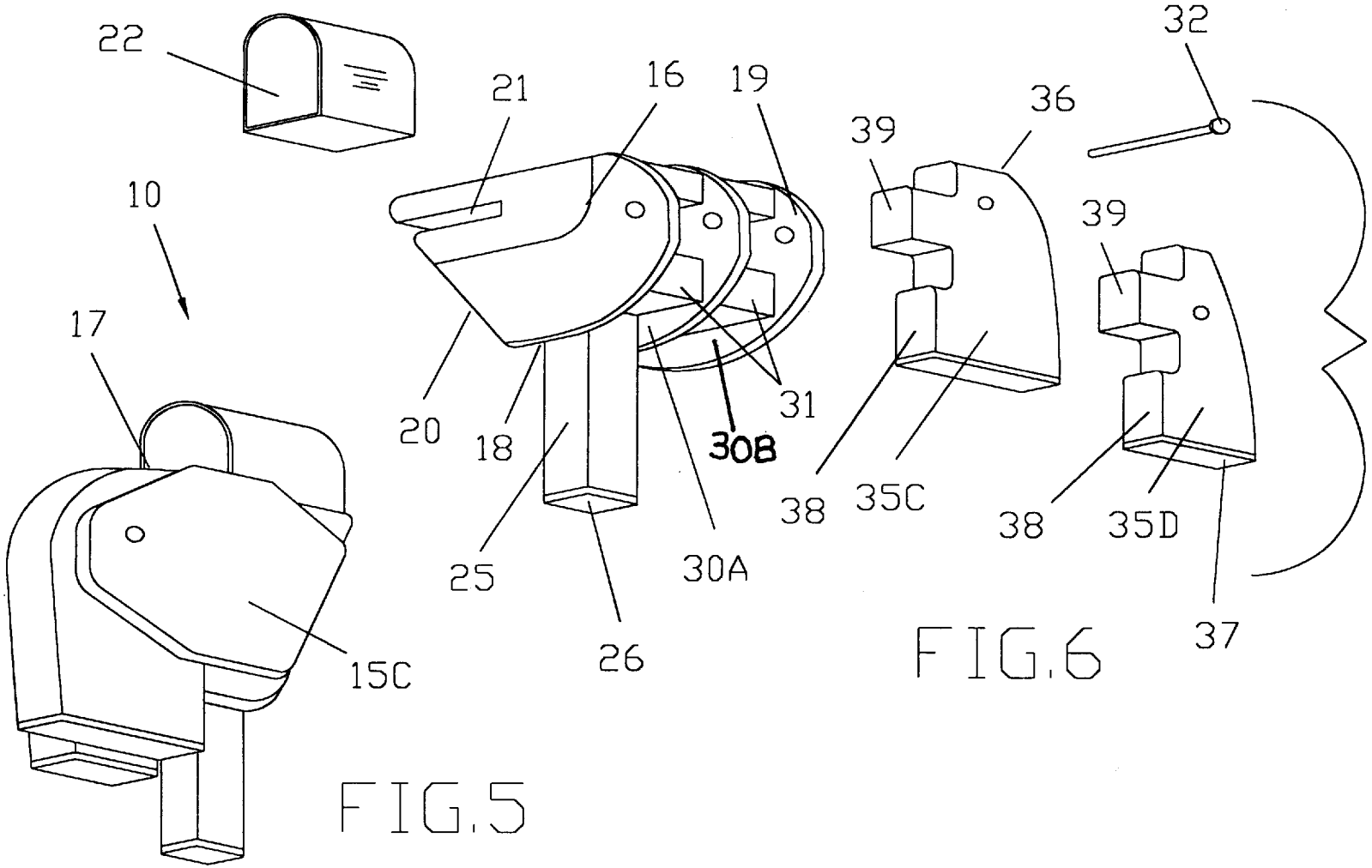
FIG. 5 is a front perspective view of the string contacting third finger member of the finger-controlled mechanism for contacting the strings on a guitar with the multiple string contact attachments attached to the body of the finger member.
FIG. 6 is a rear perspective view of the string contacting third finger member of the finger-controlled mechanism for contacting the strings on a guitar with the multiple string contact attachments removed from the body of the finger member.
Figure 7:
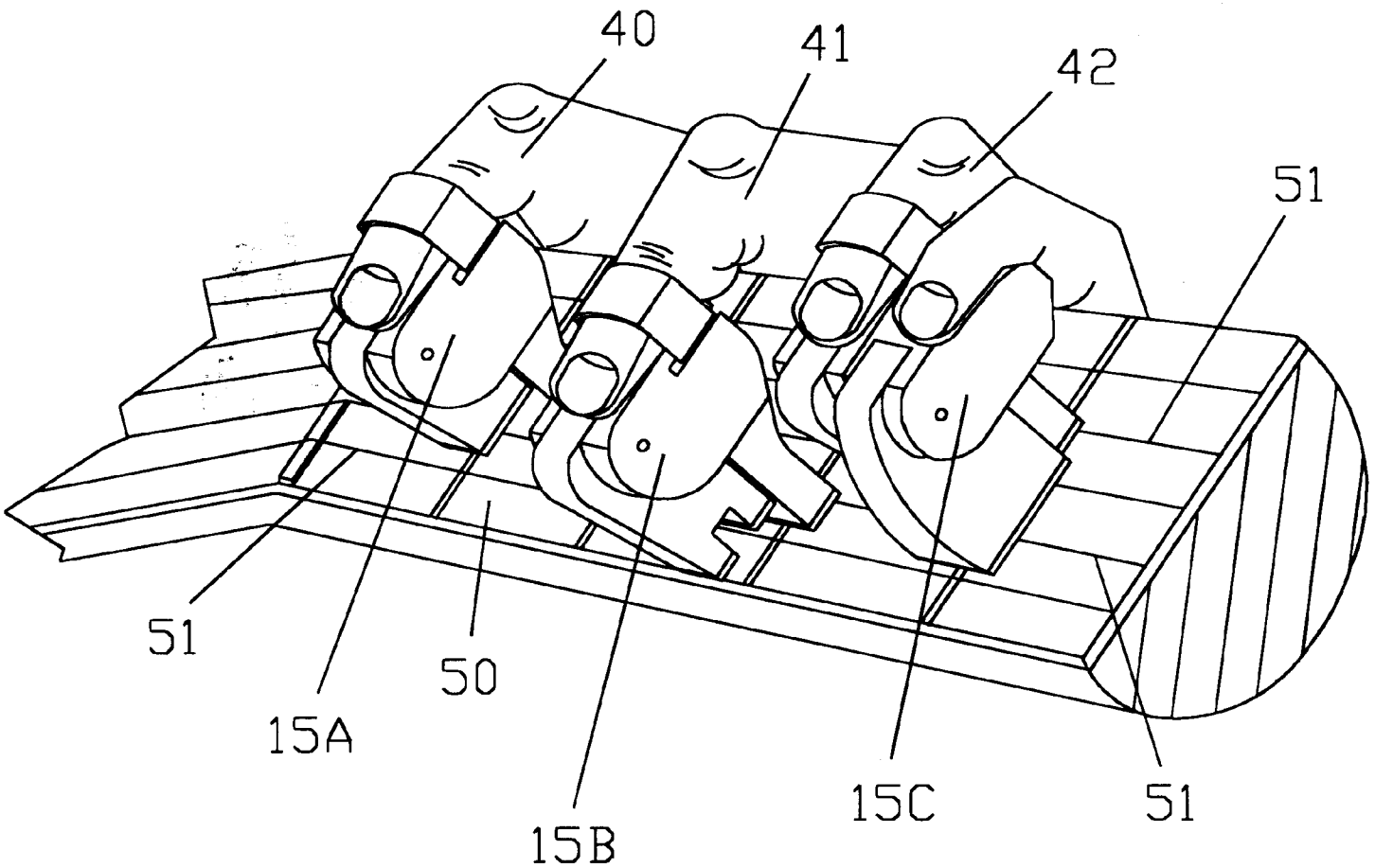
FIG. 7 is a perspective view of the finger-controlled mechanism for contacting the strings on a guitar as they would normally be used with a fragmentary portion of the hand and guitar fingerboard included for reference.

As shown in FIG. 6, a first multiple string contact attachment 35C has a bottom end 37 which has a larger surface area than any of the other multiple string contact attachments 35A–D and which is capable of holding three consecutive strings 51 at one time against the fingerboard 50 to achieve the A chord. The first multiple string contact attachment 35C is primarily detachably attached to one of the slots 30A–B in the string-contacting third finger member 15C which primarily holds the strings 51 against the fingerboard 50 in the third fret.

Further, as shown in FIGS. 2,6, the second and third multiple string contact attachments 35A–D have bottom ends 37 which have surface areas generally equal to one another and which is capable of holding two consecutive strings 51 at one time against the fingerboard 50 to achieve a particular chord. For example, the second multiple string contact attachment 35A is primarily detachably attached in the slot 30A–B of the string-contacting index finger member 15A and primarily holds the first two strings 51 against the fingerboard 50 in the first fret to achieve the F chord. The third multiple string contact attachment 35D is primarily detachably attached in one of the slots of the string-contacting third finger member 15C and primarily holds down the second and third strings 51 in the third fret to achieve the B Flat chord.

The fourth multiple string contact attachment 35B is primarily detachably attached in the slot 30A–B of the string-contacting second finger member 15B and has a pair of stub members 37A–B extending downward from the bottom end 37 and spaced apart from one another such that two odd numbered strings 51 are held at the same time against the fingerboard 50. The surface area on the bottom of one stub member 37A is generally equal to the surface area on the bottom of the other stub member 37B with the bottom of each stub member 37A–B having a surface area which permits just one string to be held against the fingerboard 50 each time. Two nonconsecutive strings 51 are held against the fingerboard 50 usually in the second fret when the fourth multiple string contact attachment 35B is being used to achieve the D chord. The stub members 37A–B are spaced apart such that a string disposed between the two strings 51 being contacted and held against the fingerboard 50 of the guitar is not contacted by the stub members 37A–B and is not held against the fingerboard 50 of the guitar.

These three string-contacting finger members 15A–C saves the users fingers and allows users with large fingers to better able play the guitar without worry of their fingers overlapping strings 51 when not called for on the fingerboard 50. In use, the user slides the finger mount of the string-contacting index finger member 15A over the index finger 40 and over the second segment of the index finger 40 and further slides the finger mount of the string-contacting second finger member 15B over the second segment of the second finger 41 and also slides the finger mount of the string-contacting third finger member 15C over the second segment of the third finger 42 such that the bodies of all three string-contacting finger members 15A–C are disposed on the palm-side of the hand which is used to press the strings 51 against the fingerboard 50 of the guitar. Depending upon the musical chord, the user will use all three string-contacting finger members 15A–C to press selected strings 51 against the fingerboard 50.

Various changes and departures may be made to the invention without departing from the spirit and scope thereof. Accordingly, it is not intended that the invention be limited to that specifically described in the specification or as illustrated in the drawings but only as set forth in the claims.

What is claimed is:

1. Finger-controlled means for contacting the strings on a guitar comprising:

at least one string-contacting finger member having a body which has a bottom, a top, a front end, and a back end, and further having a single string contact stem extending outwardly from said body for holding a single string against the fingerboard of a guitar during the playing thereof;

a finger mounting means for securing said at least one string-contacting finger member to a finger of a user; and at least one multiple string contact attachment removably attached to said at least one string-contacting finger member and having a bottom end which is capable of concurrently holding a plurality of strings against said fingerboard to achieve a particular musical chord during the playing of said guitar.

2. Finger-controlled means for contacting the strings on a guitar according to claim 1, wherein said at least one string-contacting finger member, when put on the finger, is disposed on a palm-side of a hand of said user such that said user's finger tip essentially maniplulates said at least one finger-contacting finger member.

3. Finger-controlled means for contacting the strings on a guitar according to claim 2, wherein said single string contact stem extends downwardly from said bottom of said body and is disposed near said back end of said body.

4. Finger-controlled means for contacting the strings on a guitar according to claim 3, wherein said single string contact stem has a distal end having a sufficient surface area for holding not more than a single string against said fingerboard during the use of said at least one string-contacting finger member.

5. Finger-controlled means for contacting the strings on a guitar according to claim 4, wherein said distal end of said single string contact stem has a surface which is slightly angled rearwardly upward relative to said body for facilitating the holding of a single string against said fingerboard during the use of said at least one string-contacting finger member.

6. Finger-controlled means for contacting the strings on a guitar according to claim 5, wherein said body has at least one slot in said front end thereof for attachably and securely receiving said at least one multiple string contact member one at time.

7. Finger-controlled means for contacting the strings on a guitar according to claim 6, wherein said finger mounting means is a band which allows said user to place one's finger therein and upon said top of said body so as to have finger tip control of said at least one string-contacting finger member on said fingerboard.

8. Finger-controlled means for contacting the strings on a guitar according to claim 7, wherein said at least one multiple string contact member includes a generally narrow, elongate member having a top portion which is removably received in said at least one slot of said body and being extended downwardly from said body such that said bottom end is below said body.

9. Finger-controlled means for contacting the strings on a guitar according to claim 8, wherein said single string contact stem is relatively longer than that of said at least one multiple string contact member to facilitate the playing of the selected musical chords.

10. Finger-controlled means for contacting the strings on a guitar according to claim 9, wherein said at least one string-contacting finger member includes a string-contacting index finger member which fits upon and is controlled by the index finger of the user.

11. Finger-controlled means for contacting the strings on a guitar according to claim 10, wherein said at least one string contacting finger member includes a string-contacting second finger member which fits upon and is controlled by the second finger of the user.

12. Finger-controlled means for contacting the strings on a guitar according to claim 11, wherein said at least one string contacting finger member includes a string-contacting third finger member which fits upon and is controlled by the third finger of the user.

13. Finger-controlled means for contacting the strings on a guitar according to claim 12, wherein said single string contact stem extends from said bottom of said string-contacting third finger member and is generally offset to one side thereof to facilitate playing selected musical chords with the third finger.

14. Finger-controlled means for contacting the strings on a guitar according to claim 12, wherein said string-contacting third finger member further comprises a pair of said at least one slot disposed side-by-side in said front end thereof for receiving a pair of said at least one multiple string contact member.

15. Finger-controlled means for contacting the strings on a guitar according to claim 14, wherein said at least one multiple string contact attachment includes a first multiple string contact attachment which has said bottom end which has a surface area capable of concurrently holding three consecutive strings against the fingerboard of the guitar during the playing thereof to achieve selective a musical chord such as the A chord.

16. Finger-controlled means for contacting the strings on a guitar according to claim 15, wherein said at least one multiple string contact attachment includes a second and a third multiple string contact attachment each of which has said bottom end which has a surface capable of concurrently holding two consecutive strings against the fingerboard of the guitar, during the playing thereof to achieve selective musical chords such as the F chord and the B flat chord.

17. Finger-controlled means for contacting the strings on a guitar according to claim 16, wherein said at least one multiple string contact attachment includes a fourth multiple string contact attachment which has two spaced apart stub members extending from said bottom end, said stub members having surface areas capable of concurrently holding two nonconsecutive strings against the fingerboard of the guitar during the playing thereof to achieve a selective musical chord such as the D chord.

18. Finger-controlled means for contacting the strings on a guitar according to claim 17, wherein each of said stub members has said bottom which has a surface area capable of concurrently holding only one string against the fingerboard of the guitar.

19. Finger-controlled means for contacting the strings on a guitar according to claim 18, wherein said stub members are spaced apart from one another such that a string disposed between the two strings being contacted by said stub members is not held against the fingerboard of the guitar.

* * * * *